US008042662B2

(12) United States Patent
Su

(10) Patent No.: US 8,042,662 B2
(45) Date of Patent: Oct. 25, 2011

(54) TRUNK ABLE TO FIX ARTICLES IN POSITION

(76) Inventor: Kuo-Pao Su, Tainan (TW)

( * ) Notice: Subject to any disclaimer, the term of this patent is extended or adjusted under 35 U.S.C. 154(b) by 370 days.

(21) Appl. No.: 12/367,557

(22) Filed: Feb. 9, 2009

(65) Prior Publication Data

US 2010/0200349 A1 Aug. 12, 2010

(51) Int. Cl.
*A45C 13/26* (2006.01)
*B65D 85/30* (2006.01)

(52) U.S. Cl. ..... 190/115; 206/522; 383/3; 190/18 A; 190/111; 16/113.1

(58) Field of Classification Search ..... 206/552, 206/522; 383/3; 190/18 A, 115, 111; 16/113.1
See application file for complete search history.

(56) References Cited

U.S. PATENT DOCUMENTS 1,367,574 A * 2/1921 White ..... 190/111
2,844,141 A * 7/1958 Daugherty ..... 126/263.05
4,569,082 A * 2/1986 Ainsworth et al. ..... 383/3
4,573,202 A * 2/1986 Lee ..... 383/3
5,397,000 A * 3/1995 Holte et al. ..... 206/545
D383,905 S * 9/1997 Stokes et al. ..... D3/279
2006/0207849 A1* 9/2006 Sadow ..... 190/18 A
2008/0087513 A1* 4/2008 Majeau ..... 190/111
2008/0223862 A1* 9/2008 Vanderberg et al. ..... 220/592.03
2009/0255841 A1* 10/2009 Sanches et al. ..... 206/522

FOREIGN PATENT DOCUMENTS

EP 0499014 * 2/1991

* cited by examiner

*Primary Examiner* — Tri Mai

(57) ABSTRACT

A trunk able to fix articles in position includes a trunk body and a cover connected together and respectively provided with an air bag in an interior. The trunk body has one outer side formed with an accommodating groove installed therein with an inflation apparatus provided with an inflating pipe communicating with the air bags. In using, the air inflation apparatus is taken out of the accommodating grove and then pressed or trodden for pumping air into the air bags through the inflation pipe to let the soft air bags expand and fill up the space in the trunk body. Thus, the inflated air bags can function to press and restrictedly position the articles stably in the trunk and also protect the articles in the trunk from being moved, bumped with each other and damaged.

1 Claim, 5 Drawing Sheets

TRUNK ABLE TO FIX ARTICLES IN POSITION

BACKGROUND OF THE INVENTION

1. Field of the Invention

This invention relates to a trunk able to position articles in the interior, particularly to one having a trunk body and a cover respectively provided with a soft air bag in the interior and an inflating apparatus for pumping air into the air bags to let them expand and fill up the space in the trunk. Thus, the inflated air bags can function to press and restrictedly position the articles in the trunk and also protect the articles in the trunk from being bumped and damaged.

2. Description of the Prior Art

As commonly known, a trunk is used for loading various kinds of articles therein, such as clothes, implements and materials, souvenir and the like, so that the articles can be transported or carried conveniently. However, the articles placed in the trunk may have different height, width and thickness; therefore, the articles in the trunk can hardly be kept orderly and fixed in position and as a result, the clothes in the trunk cannot be pressed and kept flat, likely to be wrinkled. In addition, the lining of a conventional trunk is provided with no protective members for preventing articles from being moved and bumped with each other, and hence the articles in the trunk are liable to be damaged if the trunk is held improperly, bumped up and down or forcefully pressed during a journey.

SUMMARY OF THE INVENTION

The objective of this invention is to offer a trunk able to fix articles in position. The trunk body and the cover of the trunk are respectively provided with a soft air bag in the interior, and an inflating apparatus is disposed for pumping air into the air bags to let the air bags expand and fill up the space in the trunk. Thus, the inflated air bags can function to press and restrictedly position the articles stably in the trunk and also have effect of shock-absorbing and anti-collision.

A first feature of this invention is that the trunk body and the cover of a trunk are connected together and respectively provided with a soft air bag in the interior, and the trunk body has one outer side formed with an accommodating groove for receiving an inflating apparatus therein. The inflating apparatus is provided with inflating pipes connected with the air bags.

A second feature of this invention is the trunk body and the cover of the trunk are connected together and respectively disposed with a soft air bag in the interior, and the trunk body has one side assembled with a pull rod unit consisting of position-limiting tubes and telescopic rods respectively inserted in the position-limiting tubes. The telescopic rods have their lower ends respectively fixed with a piston, and the position-limiting tubes have their lower portions respectively provided with an inflating pipe communicating with the air bag.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
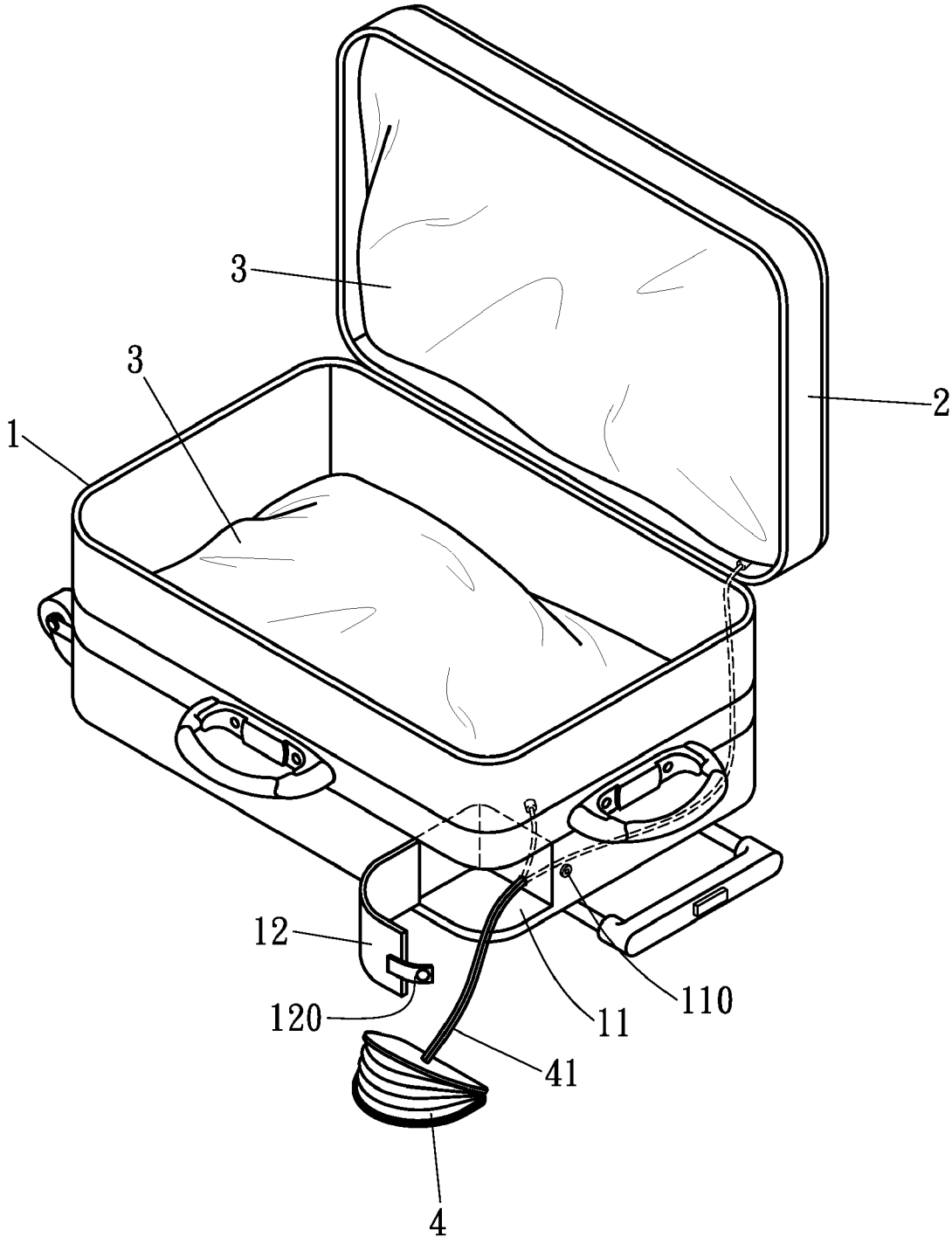
FIG. 1 is a perspective view of a first preferred embodiment of a trunk able to fix articles in position in the present invention.

A first preferred embodiment of a trunk able to fix articles in position in the present invention, as shown in FIG. 1, includes a trunk body 1, a cover 2 connected with the trunk body 1 and a soft air bags 3 respectively provided in the interior of the trunk body 1 and the cover 2. The trunk body 1 has one outer side formed with a small accommodating groove 11 for receiving an inflating apparatus 4 therein. The inflating apparatus 4 is provided with an inflating pipe 41 communicating with the air bags 3. Further, the accommodating groove 11 of the trunk body 1 is assembled with an outer cover 12 to be covered thereon, and the outer cover 12 and the accommodating groove 11 have their outer edge respectively fixed with a retaining member 120 and a retaining button 110 engaging with the retaining member 120.

Figure 2:
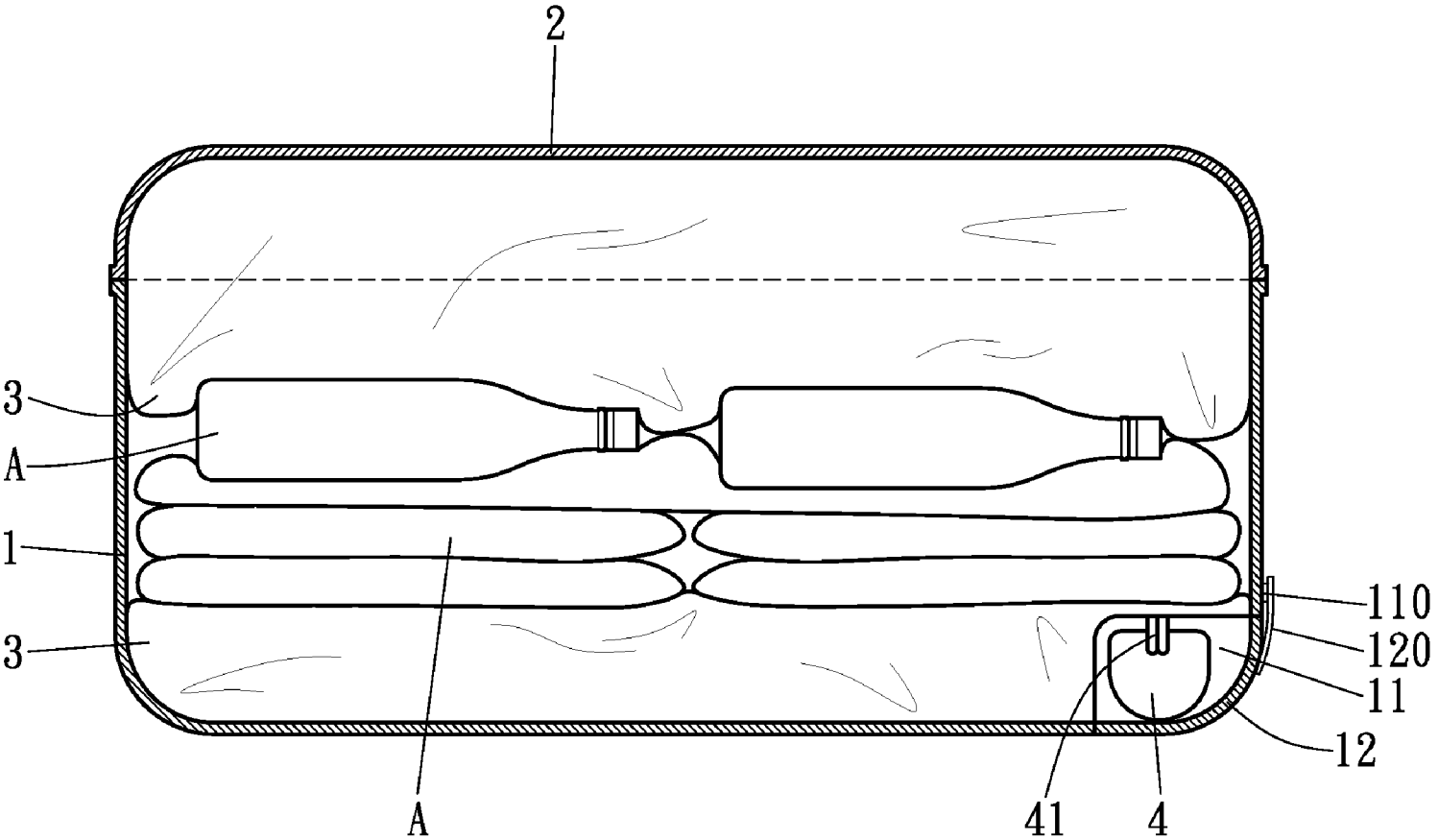
FIG. 2 is a cross-sectional view of the first preferred embodiment of the trunk able to fix articles in position in the present invention, showing it in a using condition in the present invention.

In using, referring to FIGS. 1 and 2, after articles (A) are orderly placed in the trunk body 1 and the cover 2 is covered on the trunk body 1, the inflating apparatus 4 is taken out of the accommodating groove 11 and then pressed or treaded upon repeatedly to pump air into the air bags 3 through the inflation pipes 41 to let the air bags 3 at the bottom of the trunk body 1 and the cover 2 expand toward and fill up the central interior space in the trunk body 1. At this time, the soft air bags 3 can be deformed along closely with the shapes of the articles (A) in the trunk body 1. Thus, the inflated air bags 3 can function to press and restrictedly position the articles (A) stably in the trunk body 1 and also protect the articles in the trunk from being collided with each other and damaged.

After used, the inflating apparatus 4 is put back in the accommodating groove 11 in the outer side of the trunk body 1, and the retaining member 120 of the outer cover 12 and the retaining button 110 at the outer edge of the accommodating groove 11 are correspondingly fastened together. Thus, the inflating apparatus 4 can be concealed in the accommodating groove 11 and after covered on the accommodating groove 11, the outer cover 12 can be combined together with the trunk body 1 as integral.

Figure 3:
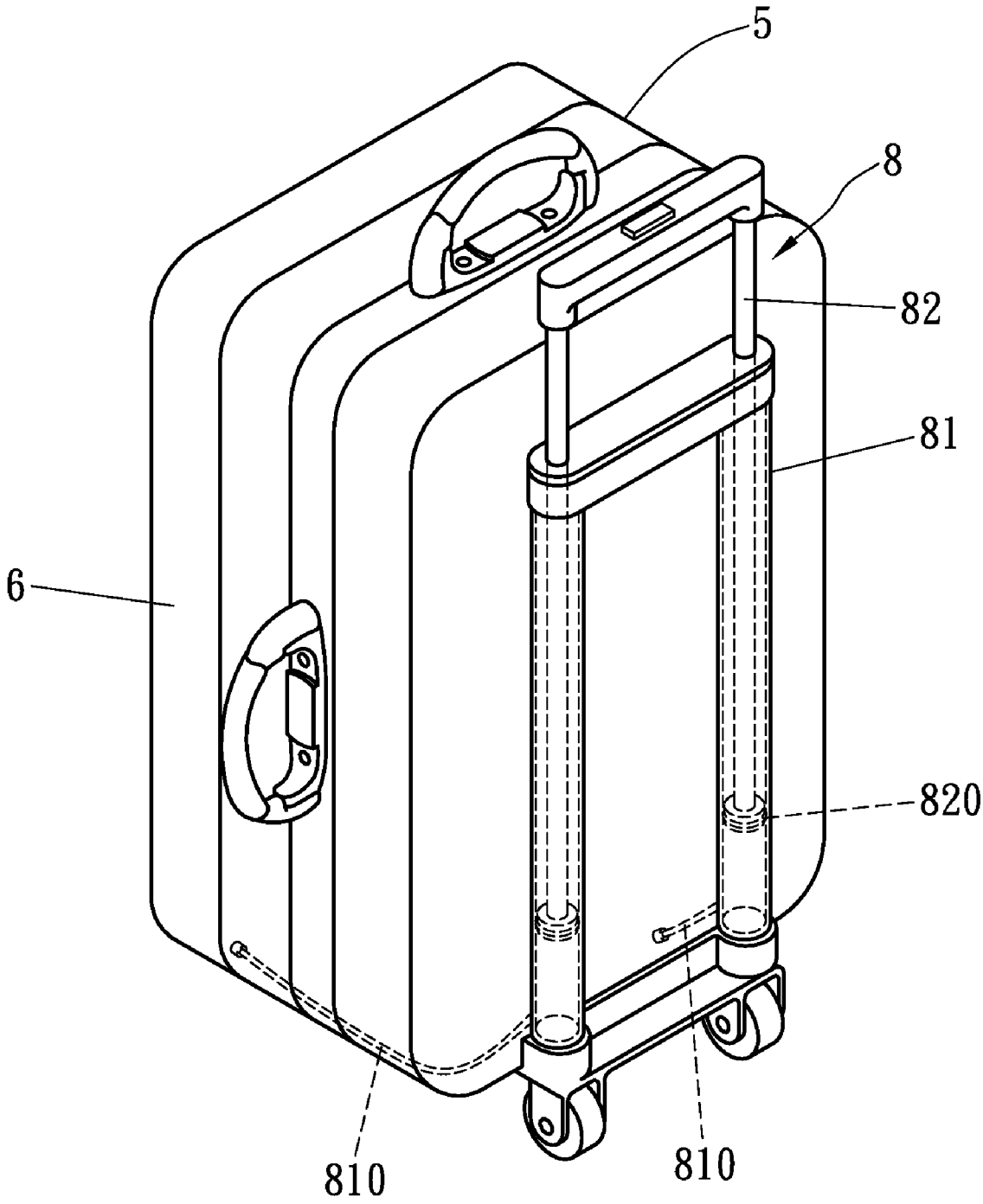
FIG. 3 is a perspective view of a second preferred embodiment of a trunk able to fix articles in position in the present invention.
Figure 4:
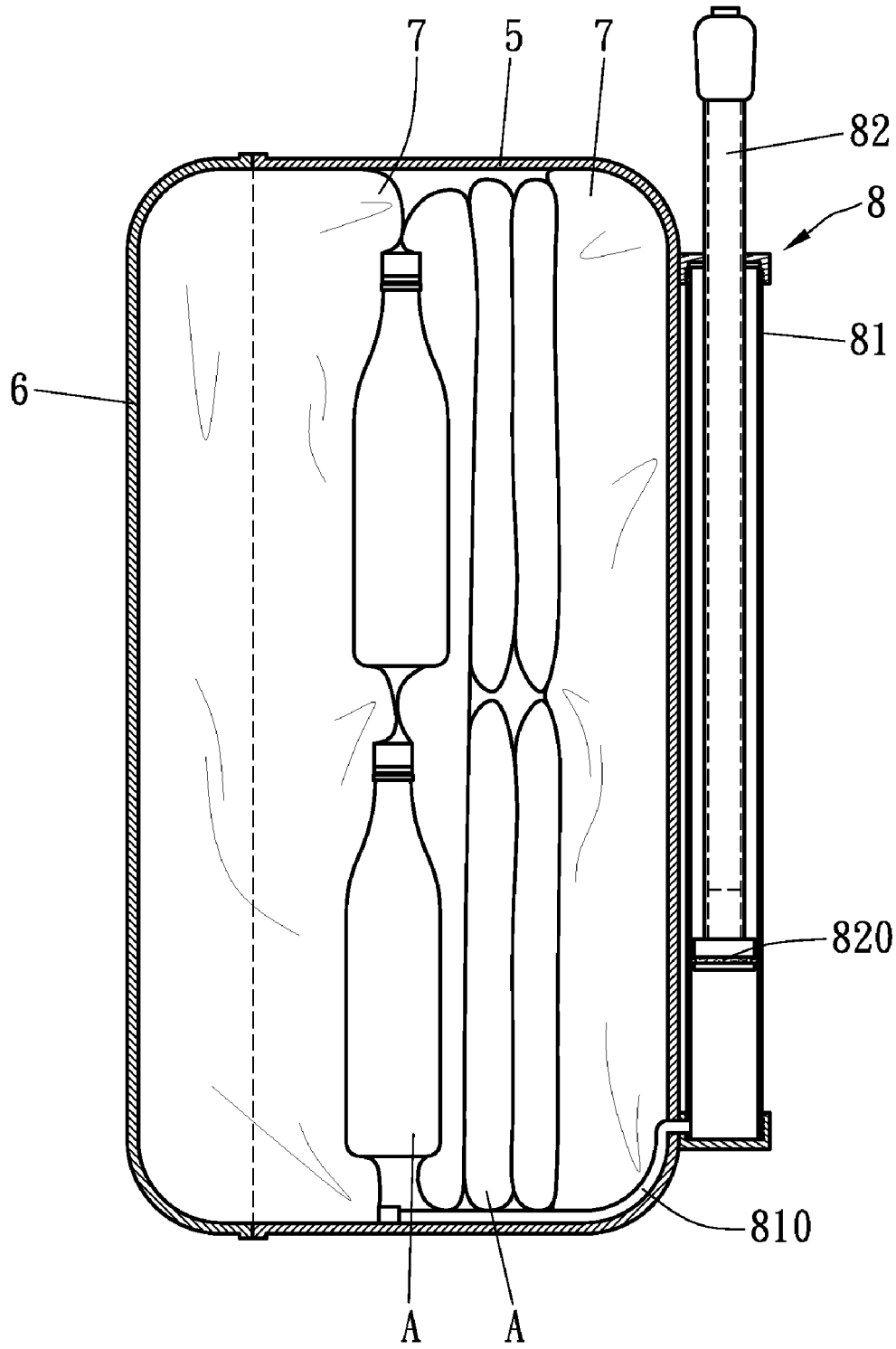
FIG. 4 is a cross-sectional view of the second preferred embodiment of the trunk able to fix articles in position in the present invention, showing it in a using condition in the present invention.
Figure 5:
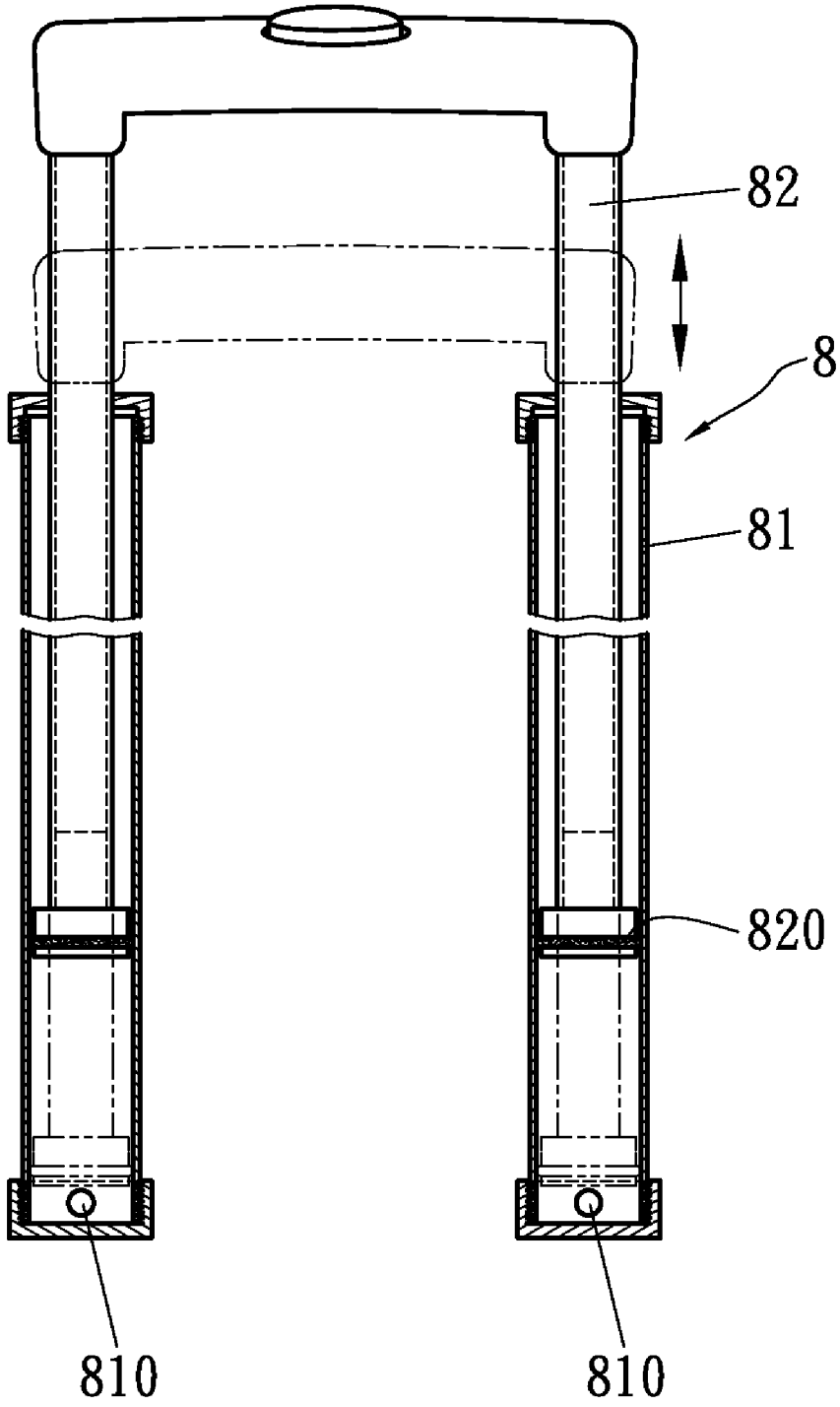
FIG. 5 is a cross-sectional view of the second preferred embodiment of the trunk having two telescopic rods operated in the present invention.

A second preferred embodiment of a trunk able to fix articles in position in the present invention, as shown in FIGS. 3, 4 and 5, includes a trunk body 5 and a cover 6 connected together. The trunk body 5 and the cover 6 are respectively provided with a soft air bag 7 in the interior, and the trunk body 5 has one side disposed with a pull rod unit 8 consisting of a pair of position-limiting tubes 81 and a pair of telescopic rods 82. The two telescopic rods 82 are respectively inserted in the two position-limiting tubes 81, having their inner lower ends respectively set with a piston 820. The two position-limiting tubes 81 have their lower portions respectively assembled with an inflation pipe 810 communicating with the air bag 7.

In using the second embodiment, referring to FIGS. 3, 4 and 5, after articles are placed in the trunk body 5 and the cover 6 is covered on the trunk body 5, simply press down and pull up the telescopic rods 82 of the pull rod unit 8 repeatedly to let the pistons 820 at the bottoms of the two telescopic rods 82 carry out reciprocating action in the position-limiting tubes 81. Thus, air can be pumped into the air bags 7 through the inflating pipes 810 to let the air bags 7 expand and fill up the space in the trunk. Thus, the inflated air bags 7 are able to press and restrictedly position the articles stably in the trunk body 5, also have effect of anti-shock and anti-collision.

While the preferred embodiments of the invention have been described above, it will be recognized and understood that various modifications may be made therein and the appended claims are intended to cover all such modifications that may fall within the spirit and scope of the invention.

What is claimed is:

1. A trunk able to fix articles in position comprising a trunk body and a cover connected together, said trunk body and said cover-respectively provided with an air bag in an interior, said trunk body having one side assembled with a pull rod unit, said, pull rod unit consisting of position-limiting tubes and telescopic rods, said telescopic rods respectively inserted in said position-limiting tubes, said telescopic rods respectively installed with a piston at a lower end, said position-limiting tubes respectively having a lower portion connected with an inflating pipe communicating with said air bag.

* * * * *